United States Patent [19]

Nahmias

[11] Patent Number: 4,726,155

[45] Date of Patent: Feb. 23, 1988

[54] COLLAPSIBLE SHELTER

[76] Inventor: Abraham Nahmias, Saraf St. 7,, Ramat Hasharon, Israel

[21] Appl. No.: 889,835

[22] Filed: Jul. 28, 1986

[30] Foreign Application Priority Data

Jul. 31, 1985 [IL] Israel ..... 75983

[51] Int. Cl.[4] ..... E04B 1/344

[52] U.S. Cl. ..... 52/71; 52/79.5

[58] Field of Search ..... 52/71, 79.5, 64, 745, 52/742; 135/109, 106, 87

[56] References Cited

U.S. PATENT DOCUMENTS

| | | | |
|---|---|---|---|
| 837,937 | 12/1906 | Legg | 52/71 |
| 3,118,186 | 1/1964 | Moss | 52/71 |
| 3,714,749 | 2/1973 | Aitken | 52/71 X |
| 3,766,693 | 10/1973 | Richards et al. | 52/71 |
| 3,854,266 | 12/1974 | Salas | 52/742 |
| 4,151,687 | 5/1979 | Kephart | 52/71 |
| 4,616,452 | 10/1986 | Lemerre | 52/71 |

FOREIGN PATENT DOCUMENTS

| | | | |
|---|---|---|---|
| 331272 | 10/1935 | Italy | 52/71 |

*Primary Examiner*—J. Karl Bell

*Attorney, Agent, or Firm*—Benjamin J. Barish

[57] ABSTRACT

A collapsible shelter, comprises a first group of panels hingedly connected to each other in accordion fashion to permit them to be moved to an open condition to define the walls of the shelter, or to be collapsed to a folded condition for storage or transportation; a second group of panels hingedly connected to each other in accordion fashion to permit them to be moved to an open condition to define the roof of the shelter, or to be collapsed to a folded condition for storage or transportation; retainer devices for retaining the panels of each group in their open condition; and securing devices for securing the second group of panels, when in their open condition to define the roof of the shelter, to the upper end of the first group of panels when in their open condition to define the walls of the shelter.

19 Claims, 11 Drawing Figures

FIG 1
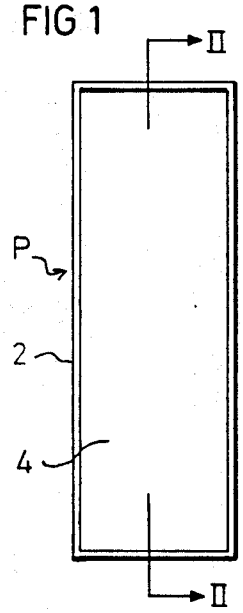
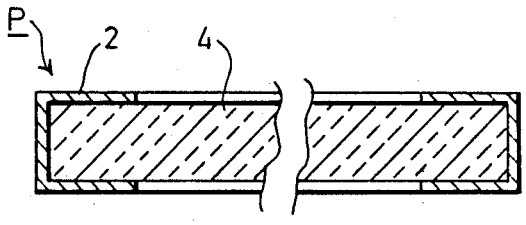
FIG. 2
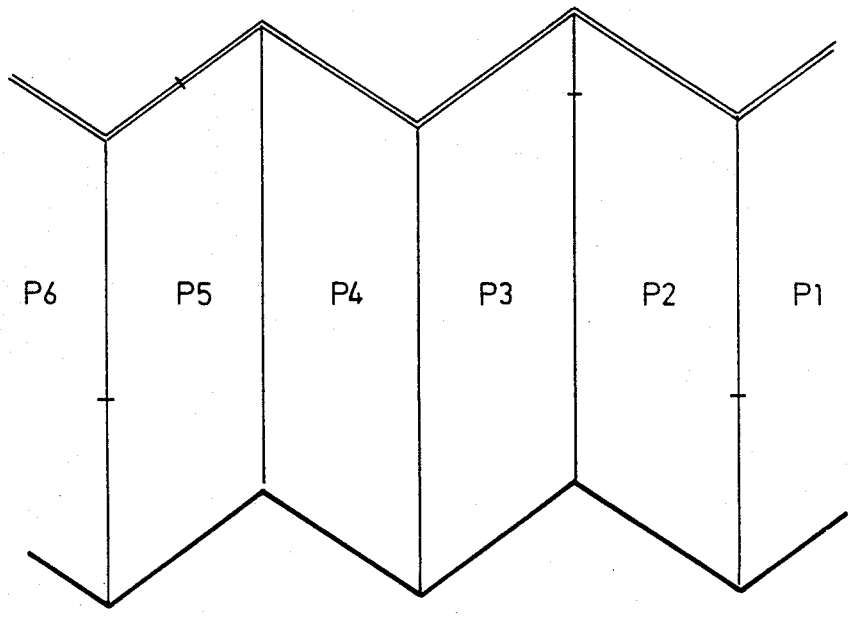
FIG. 3

FIG 4
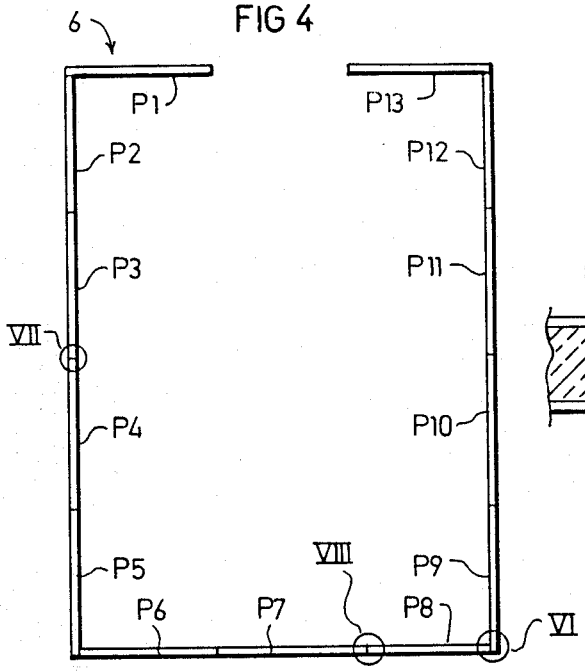
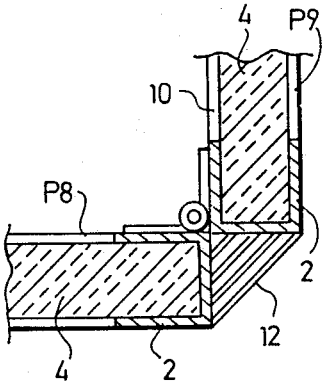
FIG 6
FIG 5
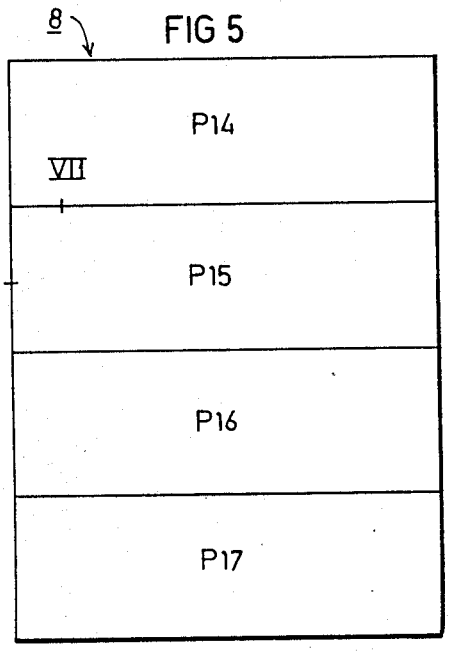
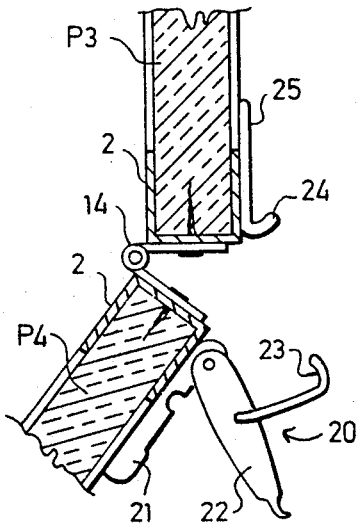
FIG 7

FIG 8
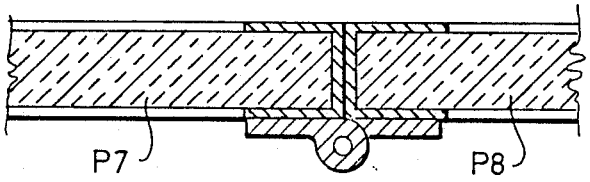
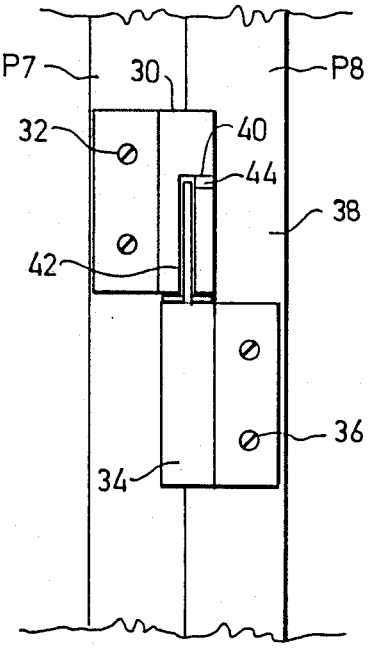
FIG 9
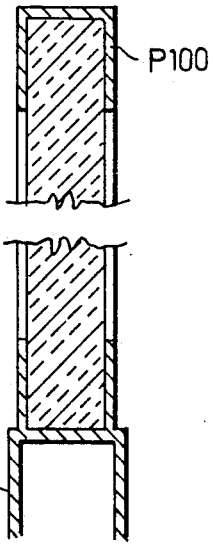
FIG 11
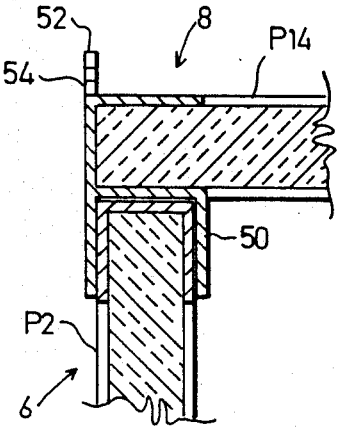
FIG 10

COLLAPSIBLE SHELTER

BACKGROUND OF THE INVENTION

The present invention relates to collapsible shelters, such as shelters frequently used outdoors to protect the occupants against adverse weather conditions, (e.g. sun, rain), and to be collapsed when not in use for storage or transportation.

Probably the most popular type of collapsible shelter is the conventional tent made of canvas or other sheet material erected by means of poles and ground stakes. Such collapsible shelters, however, particularly the larger size ones, are difficult and time consuming to erect for use, and to collapse when not in use.

An object of the present invention is to provide another form of collapsible shelter which can be quickly and easily erected and collapsed.

SUMMARY OF THE INVENTION

According to a broad aspect of the present invention, there is provided a collapsible shelter, comprising: a first group of panels hingedly connected to each other in accordion fashion to permit them to be moved to an open condition to define the walls of the shelter, or to be collapsed to folded condition for storage or transportation; a second group of panels hingedly connected to each other in accordion fashion to permit them to be moved to an open condition to define the roof of the shelter, or to be collapsed to a folded condition for storage or transportation; retainer means for retaining the panels of each group in their open condition; and securing means for securing the second group of panels, when in their open condition to define the roof of the shelter, to the upper end of the first group of panels when in their open condition to define the walls of the shelter.

According to a preferred feature in the novel collapsible container, the first group of panels further includes stop elements between selected pairs of contiguous panels to limit their open positions to a predetermined angle, and thereby to define the corners of the walls of the shelter; in the described preferred embodiment, the stop elements limit the respective contiguous panels to an angle of 90°, whereby the first group of panels define four walls at right angle to each other in the open condition of the panels.

According to further preferred features, the retainer means locks each pair of contiguous panels of the first group of panels not provided with the stop elements, and each pair of contiguous panels of the second group, in alignment with each other to form a straight section of the wall or roof in the open condition of the two groups of panels; in the described preferred embodiment, the retainer means comprises a toggle locking mechanism between the respective pairs of contiguous panels.

According to still preferred features, each of the panels comprises a rigid frame defining the periphery of the respective panel, and a block of light insulating material received within the rigid frame; in the described preferred embodiment, the rigid frame comprises aluminum channel members of U-section constituting each side of the frame, and the block of light insulating material received therein is of expanded plastic material.

The foregoing features enable the construction of shelters which can be erected and collapsed very quickly and easily, and which can be collapsed to form a compact and light package for convenient transportation or storage. In addition, the panels of the collapsible shelter define modular units which can be constructed and assembled in volume for any desired shelter size.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a front elevational view illustrating one of the panels serving as a modular unit for constructing a collapsible shelter in accordance with the present invention;

FIG. 2 is an enlarged, fragmentary, sectional view along lines II—II of FIG. 1;

FIG. 3 illustrates a plurality of panels, each according to FIG. 1, hingedly connected to each other in accordion fashion to form a part of the wall of a collapsible shelter;

FIG. 4 is a top plan view of a plurality of panels hingedly connected to each other in accordion fashion, as illustrated in FIG. 3, but shown in their fully open condition to define the wall of the shelter;

FIG. 5 is a top plan view illustrating a plurality of panels all connected together in accordion fashion as illustrated in FIG. 3, but constituting a second group of panels to define the roof of the shelter;

FIG. 6 illustrates the ends of pair of contiguous panels having stop elements limiting the open positions of the panels to define the corners of the shelter wall;

FIG. 7 illustrates retainer means applied at the ends of most of the panels to lock them in alignment with each other and thereby to form straight sections of the wall and roof in the open condition of the panels;

FIGS. 8 and 9 are a sectional view, and an end elevational view, respectively, illustrating the means for securing the ends of the panels together to interconnect the two wall sections of the shelter;

FIG. 10 illustrates means for securing the roof to the wall of the shelter; and

FIG. 11 illustrates a modificatin in the construction of the panels serving to define the wall and/or the roof of the shelter.

DESCRIPTION OF A PREFERRED EMBODIMENT

The shelter illustrated in the drawings comprises a plurality of rectangular panels, each constructed as illustrated in FIGS. 1 and 2 with long and short sides, assembled together to form a first group of panels illustrated in FIGS. 3 and 4 to constitute the walls of the shelter, and a second group of panels illustrated in FIG. 5 to constitute the roof of the shelter. Both groups of the panels are hingedly connected together along their long sides in accordion fashion so that the panels of each group may be moved to an open condition to define the wall or the roof of the shelter, or to be collapsed to a folded condition for convenient storage or transportation.

Each panel, generally designated P in the drawings, is of rectangular configuration having a height corresponding to the full height of the shelter to be assembled. Each panel comprises a rigid frame 2 defining the periphery of the respective panel, and a block of light insulating material 4 received within the rigid frame. Particularly good results have been obtained when the rigid frame 2 is constituted of aluminum channel members of U-section, and the block of light insulating material 4 is of expanded plastic material, such as foamed polyurethane.

In the illustrated example, each panel P is of a height of 195 cm, and a width of 2 cm; and each of the three legs of the U-shaped channel member, constituting the legs 2, is of a length of 2 cm.

The wall of the shelter is generally designated 6 in FIG. 4 and is constituted of 13 panels $P_1$–$P_{13}$; and the roof, generally designated 8 in FIG. 5, is constituted of 4 panels $P_{14}$–$P_{17}$. Preferably, the first group of panels constituting the wall 6 (FIG. 4) is divided into two sections, one section including 7 panels $P_1$–$P_7$, and the other section including the remaining 6 panels $P_8$–$P_{13}$, the two sections being connected together at their ends by a securing arrangement generally designated VIII in FIG. 4 and more particularly illustrated in FIGS. 8 and 9.

With respect to panels $P_1$–$P_{13}$ defining the wall of the shelter, in addition to the connector structure illustrated at VIII in FIG. 4 (more particularly illustrated in FIGS. 8 and 9), these panels include a corner structure, generally designated VI in FIG. 4 (and more particularly illustrated in FIG. 6), and a retainer structure generally designated VII in FIG. 4 (and more particularly illustrated in FIG. 7).

As shown in FIG. 6, the corner structure (VI in FIG. 4) includes a hinge 10 hingedly connecting the ends of the two contiguous panels ($P_8$–$P_9$) so as to permit them to be folded on top of each other or to be moved to the open position, illustrated in FIG. 6, when the group of panels $P_1$–$P_{13}$, constituting the shelter wall, are moved to their open condition illustrated in FIG. 4. One of the two contiguous panels, however, this being panel $P_8$ in FIG. 6, has secured thereto a stop element 12 of triangular cross-section to limit the opening position of the two contiguous panels to an angle of 90°, thereby defining the respective corner of the wall 6.

In the illustrated embodiment, the wall 6 defined by the 13 panels $P_1$–$P_{13}$ is of rectangular configuration, and therefore stop elements 12 at the four corners limit the open positions of the contiguous panels at these corners to an angle of 90°. It will be appreciated, however, that if a 5-sided wall or a 6-sided wall were to be defined by these panels, the stop elements 12 provided at the corners would limit the open positions of the contiguous panels to the appropriate angle for the particular configuration of wall to be formed by those panels.

The remaining hinge connections between contiguous panels not serving as the corners of the wall include retainer means, generally designated VII in FIG. 4 and more particularly illustrated in FIG. 7, which locks each pair of contiguous panels into alignment with each other to form a straight section of the wall 6 in the open condition of the panels. FIG. 7 illustrates the retainer means between panels $P_3$ and $P_4$, which panels are hingedly connected to each other by a hinge 14 permitting the two panels to be folded on top of each other when the shelter is not in use, and to be extended to their open positions when erecting the shelter. The locking means is in the form of a toggle locking mechanism, generally designated 20, which firmly locks the two contiguous panels into alignment with each other in the open condition of the panels.

Thus, toggle mechanism 20 comprises a mounting member 21 mounted to the aluminum frame 2 at the end of one panel $P_4$, a handle 22 pivotably mounted at one end to mounting member 21, and a hook 23 pivotably mounted at a mid-portion of handle 22. Hook 23 is adapted to engage a hook 24 formed at the inner end of a mounting member 25 secured to the aluminum frame section 2 at the end of the other panel $P_3$. It will be seen that when the two panels $P_3$, $P_4$ are to be folded against each other in the collapsed condition of the shelter wall, hook 23 carried at the end of handle 22 is released from hook 24 carried at the end of the other panel $P_3$; but when the two panels are to be locked in alignment with each other in the open condition of the shelter wall, hook 23 is engaged with hook 24, and handle 22 is pressed downwardly into alignment with its mounting member 21, whereby the engagement of hooks 23 and 24 securely locks the two panels $P_3$ and $P_4$ in alignment with each other.

The connecting structure diagrammatically shown at VII in FIG. 4 for connecting together the ends of the two panel sections $P_1$–$P_7$ and $P_8$–$P_{13}$, respectively, is more particularly illustrated in FIGS. 8 and 9. Thus, a hinge 30 is fixed, as by fasteners 32, to the end of panel $P_7$, and another hinge 34 is fixed, as by fasteners 36, to the other panel $P_8$ to underly hinge 30. Hinge 34 has a socket receiving a pin 38 formed with an out-turned end 40 at its upper end; and hinge 30 is formed with a recess 42 also formed with an out-turned slot 44 at its upper end. The arrangement is such that pin 38 is normally received within the socket in hinge 34, but when panel $P_8$ is to be connected to panel $P_7$, the user engages the out-turned end 40 of pin 38, lifts the pin through slot 42 in hinge 30, and then turns the end so as to bring the head 40 into slot 44 of hinge 30, thereby securing together the ends of panels $P_7$ and $P_8$.

With respect to the hinged structure of the four panels $P_{14}$–$P_{17}$ defining the roof 8 illustrated in FIG. 5, each pair of contiguous panels of this group includes retainer means, diagrammatically designated VII in FIG. 5, corresponding to the retainer means VII in FIG. 4 and more particularly illustrated in FIG. 7, for locking the ends of the respective panels into straight alignment with each other in the open condition of the panels defining the roof.

FIG. 10 illustrates the manner of securing the roof 8 (FIG. 5), constituted of the four panels $P_{14}$–$P_{17}$, to the walls 6 (FIG. 4) constituted of the 13 panels $P_1$–$P_{13}$. This is effected by providing the wall illustrated in FIG. 4 by connecting the end of panel $P_7$ to the end of panel $P_8$ by lifting pin 38 (FIG. 9) in hinge 34 of panel $P_8$ through the recess 42 in hinge 30 of panel $P_7$ and then rotating the head 40 of the pin so as to sat it in the slot 44.

During the opening of the wall panels $P_1$–$P_{13}$, the stop elements 12 at the junctures of panels $P_1$, $P_2$; $P_5$, $P_6$; $P_8$, $P_9$ and $P_{12}$, $P_{13}$ limit the contiguous panels to form an angle of 90° to each other, thereby defining the corners of four wall sections. The toggle locking mechanism 20 illustrated in FIG. 7 is operated to lock the remaining pairs of contiguous panels into alignment with each other so that these panels form straight wall sections.

The four panels $P_{14}$–$P_{17}$ constituting the roof (FIG. 5) are similarly opened and locked to form straight sections by the toggle locking mechanism illustrated in FIG. 7.

The roof 8 is then applied over the upper ends of the wall panels $P_1$–$P_{13}$ by passing the upper ends of these panels into the U-shaped channel member 50 depending from the roof panels $P_{14}$–$P_{18}$. Next, cables are then fastened to the securing members 52 at the four corners of the roof 8 (FIG. 5) and the opposite ends of the cables are anchored in the ground. lower edge of the roof panels $P_{14}$–$P_{17}$ with a channel member 50 for receiving the upper ends of the wall panels $P_1$–$P_{13}$. Channel 50 may be secured, as by welding or by the use of fasteners, to one of the legs of the frame members 2, on the side of the panel facing outwardly when the panel is collapsed to its folded condition.

The four corners of the roof panels $P_{14}$–$P_{17}$ are further provided with a securing member 52 formed with an opening 54 for securing thereto tension cables (not shown) whose opposite ends are anchored in the ground, to securely hold the roof panels $P_{14}$–$P_{17}$ firmly against the upper ends of the wall panels $P_1$–$P_{13}$ when subjected to wind forces.

The shelter illustrated in FIGS. 1–10 may be used in the following manner:

It is first to be noted that the shelter is constituted of two wall sections (namely panels $P_1$–$P_7$ and panels $P_8$–$P_{13}$), and one roof section constituted of panels $P_{14}$–$P_{17}$. These panels may be folded against each other to provide a compact assembly for storage or transportation. When the shelter is to be erected, the wall section of panels $P_1$–$P_7$ is opened to the condition illustrated in FIG. 4; and then the wall section of panels $P_8$–$P_{13}$ is also opened. The two sections are joined together to form the continuous A shelter constructed in accordance with the structure illustrated in FIGS. 1–10 can be erected for use, and collapsed when not in use, in a matter of a few minutes. The panels are all of similar construction and dimensions, and include but a few simple elements which can be produced by mass-production techniques. The elements of the shelter are also very light in weight and therefore can be carried in a case to form a very compact arrangement for storage or transportation.

In the arrangement illustrated in FIGS. 1–10, the panels are each of the complete height of the shelter wall; preferably, this height is 195 cm.

FIG. 11 illustrates a modification wherein each panel, therein designated $P_{100}$, is of a height constituting a fraction of the total height of the wall and includes means for securing a plurality of the groups of panels to each other, one above the other, to define the full height of the shelter wall. Thus, in the modification illustrated in FIG. 11, panel $P_{100}$ may be of a height of 65 cm and may be provided with a depending U-shaped channel member 100 at its lower end for attaching the panels to an underlying group of panels. Thus, the wall in the modification illustrated in FIG. 11 would include three groups of hingedly mounted wall panels, corresponding to panels $P_1$–$P_{13}$ in FIG. 4, but each panel is of a height of 65 cm (rather than 195 cm), the complete wall being constructed by assembling three groups of such panels one above the other.

Many other variations, modifications and applications of the invention will be apparent.

What is claimed is:

1. A collapsible shelter, comprising:

a first group of panels hingedly connected to each other in accordion fashion to permit them to be moved to an open condition to define the walls of the shelter, or to be collapsed to a folded condition or storage or transportation;

a second group of panels hingedly connected to each other in accordion fashion to permit them to be moved to an open condition to define the roof of the shelter, or to be collapsed to a folded condition for storage or transportation;

retainer means for retaining the panels of each group in their open condition;

and securing means for securing the second group of panels, when in their open condition to define the roof of the shelter, to the upper end of the first group of panels when in their open condition to define the walls of the shelter;

said first group of panels further including stop elements between selected pairs of contiguous panels to limit their open positions to a predetermined angle, and thereby to define the corners of the walls of the shelter.

2. The collapsible shelter according to claim 1, wherein said stop elements limit the respective contiguous panels to an angle of 90°, whereby said first group of panels define four walls at right angle to each other in the open condition of the panels.

3. The collapsible shelter according to claim 1, wherein said retainer means locks each pair of contiguous panels of the first group of panels not provided with said stop elements, and each pair of contiguous panels of the second group, in alignment with each other to form straight sections of the wall and roof in the open condition of the two groups of panels.

4. The collapsible shelter according to claim 3, wherein said retainer means comprises a toggle locking mechanism between the respective pairs of contiguous panels.

5. The collapsible shelter according to claim 1, wherein said first group of panels comprises two panel sections connectable at their ends when in the open condition to provide a continuous multi-sided wall of the shelter.

6. The collapsible shelter according to claim 5, wherein said two sections of panels constituting said first group are connectable to each other at their ends by a pivotable connecting pin receivable in a socket in the end panel of one section and having a head receivable in a recess formed in the end panel of the other section.

7. The collapsible shelter according to claim 1, wherein said securing means comprises U-shaped channel members secured to said second group of panels for receiving the upper ends of the panels of the first group in the open condition of both groups of panels.

8. The collapsible shelter according to claim 1, wherein each of said panels comprises a rigid frame defining the periphery of the respective panel, and a block of light insulating material received within said rigid frame.

9. The collapsible shelter according to claim 8, wherein said rigid frame comprises aluminum channel members of U-section constituting each side of the frame, and said block of light insulating material received therein is of expanded plastic material.

10. The collapsible shelter according to claim 1, wherein said second group of panels constituting said roof comprises securing means at the four corners of the second group of panels for securing tension cables thereto which tension cables are to be anchored to the ground.

11. The collapsible shelter according to claim 1, wherein said panels of the first group are each of a height equal to that of the walls of the shelter defined thereby in the open condition of the first group of panels.

12. The collapsible shelter according to claim 1, wherein said panels of the first group are each of a height which is a fraction of the height of the walls of the shelter defined by said first group of panels in their open condition, said first group of panels including means for securing a plurality of said first group of panels to each other, one above the other, to define the full height of the walls of the shelter.

13. The collapsible shelter according to claim 12, wherein said latter means comprises U-shaped channel members secured to the edge of one group for receiving the edges of the underlying group.

14. A collapsible shelter, comprising:

a first group of rectangular panels having long and short sides hingedly connected to each other along their long sides in accordion fashion to permit them to be moved to an open condition to define the walls of the shelter, or to be collapsed to a folded condition for storage or transportation;

a second group of rectangular panels having long and shot sides hingedly connected to each other along their long sides in accordion fashion to permit them to be moved to an open condition to define the roof of the shelter, or to be collapsed to a folded condition for storage or transportation;

each of said panels comprising a rigid frame defining the periphery of the respective panel, and a block of light insulating material received within said rigid frame;

retainer means for retaining the panels of each group in their open condition;

and securing means for securing the second group of panels, when in their open condition to define the roof of the shelter, to the upper end of the first group of panels when in their open condition to define the walls of the shelter.

15. The collapsible shelter according to claim 14, wherein said first group of panels further includes stop elements between selected pairs of contiguous panels to limit their open positions to a predetermined angle, and thereby to define the corners of the walls of the shelter.

16. The collapsible shelter according to claim 14, wherein said retainer means locks each pair of contiguous panels of the first group of panels not provided with said stop elements, and each pair of contiguous panels of the second group, in alignment with each other to form straight sections of the wall and roof in the open condition of the two groups of panels.

17. The collapsible shelter according to claim 16, wherein said retainer means comprises a toggle locking mechanism between the respective pairs of contiguous panels.

18. The collapsible shelter according to claim 14, wherein said first group of panels comprises two panel sections connectable at their ends when in the open condition to provide a continuous multi-sided wall of the shelter.

19. The collapsible shelter according to claim 14, wherein said rigid frame comprises aluminum channel members of U-section constituting each side of the frame, and said block of light insulating material received therein is of expanded plastic material.

* * * * *

UNITED STATES PATENT AND TRADEMARK OFFICE

CERTIFICATE OF CORRECTION

PATENT NO. : 4,726,155

DATED : February 23, 1988

INVENTOR(S) : Abraham Nahmias

It is certified that error appears in the above-identified patent and that said Letters Patent is hereby corrected as shown below:

Column 4, line 50, after "providing the", insert the passage starting with the words "lower edge of the roof" in column 5, line 7, and continuing through column 5, line 32 ending with the word "the continuous", and cancel that passage from column 5.

Signed and Sealed this

Twenty-fifth Day of October, 1988

*Attest:*

*Attesting Officer*

DONALD J. QUIGG

*Commissioner of Patents and Trademarks*